United States Patent [19]

Lenorak

[11] 4,262,479

[45] Apr. 21, 1981

[54] MULTITWIST SPINDLE

[75] Inventor: Ferdinand Lenorak, Bratislava, Czechoslovakia

[73] Assignee: Slovenska vedecko-technicka spolocnost, Dom techniky, Bratislava, Czechoslovakia

[21] Appl. No.: 29,112

[22] Filed: Apr. 11, 1979

Related U.S. Application Data

[63] Continuation of Ser. No. 776, Jan. 3, 1979, abandoned.

[30] Foreign Application Priority Data

Jan. 9, 1978 [CS] Czechoslovakia ..... 160/78

[51] Int. Cl.[3] ..... D01H 7/86; D01H 1/10

[52] U.S. Cl. ..... 57/58.54; 57/58.49; 57/58.55; 57/58.83

[58] Field of Search ..... 57/58.49–58.63, 57/58.83, 58.86

[56] References Cited

U.S. PATENT DOCUMENTS

| | | | |
|---|---|---|---|
| 1,983,413 | 12/1934 | Spagnolo | 57/58.54 |
| 2,053,645 | 9/1936 | Weaver | 57/58.55 |
| 2,410,674 | 11/1946 | Nelson | 57/58.55 |
| 2,550,136 | 4/1951 | Clarkson | 57/58.55 X |
| 2,654,210 | 10/1953 | Bogdanffy et al. | 57/58.55 |
| 3,867,809 | 2/1975 | Holbrook | 57/58.52 |

FOREIGN PATENT DOCUMENTS

| | | | |
|---|---|---|---|
| 2648888 | 5/1978 | Fed. Rep. of Germany | 57/58.52 |
| 1027270 | 2/1953 | France | 57/58.55 |
| 47-9539 | 3/1972 | Japan | 57/58.52 |
| 916625 | 1/1963 | United Kingdom | 57/58.54 |

*Primary Examiner*—John Petrakes

*Attorney, Agent, or Firm*—Burgess, Ryan and Wayne

[57] ABSTRACT

A multitwist spindle for processing of fibers and yarn by twisting and combining materials from at least two countershafts with equal or different heights of twist while simultaneously forming a left and right twist or a single direction combined twist. The spindle has at least one rotating shaft with a yarn carrier fixed to it and at least two rotating countershafts on which the yarn is mounted.

5 Claims, 4 Drawing Figures

MULTITWIST SPINDLE

CROSS-REFERENCE TO RELATED APPLICATION

This application is a continuation of co-pending application Ser. No. 776, filed Jan. 3, 1979, now abandoned.

BACKGROUND OF THE INVENTION

This invention relates to a multi-twist spindle for processing endless fibers and yarn by twisting, and for combining material from at least two countershafts with the simultaneous creation of a left and a right twist, or of a single direction combined twist.

Ring spindles and flyer spindles on which the fibers are wound for twisting of endless fibers, and yarn single twist spindles with a rotating countershaft, are known in the art. Double twist spindles, three twist spindles and multitwist spindles can be provided with two or more stable countershafts from which the combined fibers are taken up. These spindles are single purpose spindles. The fibers taken up from countershafts obtain the same direction and same height of the twist. These characteristics are severe limitation to the use of the equipment.

SUMMARY OF THE INVENTION

These drawbacks are eliminated by the multitwist spindle according to the present invention. The main feature of the instant multitwist spindle is the provision of a main support for the countershafts. A main shaft is rotatably mounted in the main support and a main carrier is fixed to the main shaft. In a second embodiment, first and second main carriers are provided. In another embodiment, additional carriers are located between the main support and posts. These additional carriers are designated the left and right carriers, respectively for purposes of description only. A differential gear mechanism is provided between the main carrier and the left carrier. The main support is provided with a stabilizer and a brake.

BRIEF DESCRIPTION OF THE DRAWINGS

In the following description of the preferred embodiments, reference is had to the annexed drawings in which:

FIG. 3 is a sectional elevational view of a multitwist spindle with a main carrier and left and right additional carriers according to a third embodiment of the invention.

DESCRIPTION OF THE PREFERRED EMBODIMENTS

Figure 1:
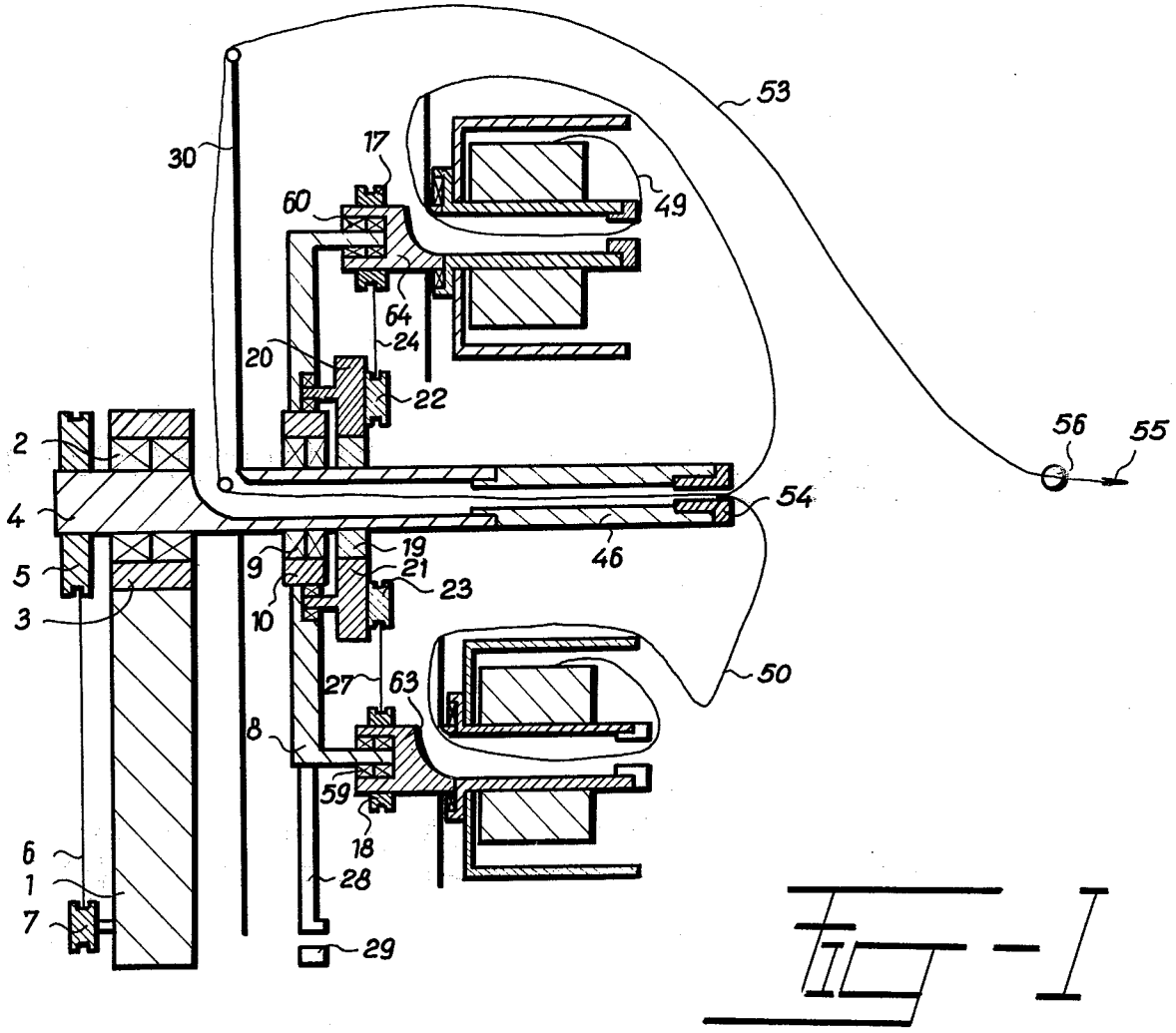
FIG. 1 is a sectional elevational view of a multitwist spindle with two countershafts on an upper and lower shaft according to a first embodiment of the invention.

Referring to FIG. 1, there is provided a multitwist spindle having a main shaft 4 to which is fixed main carrier 30. Main shaft 4 is rotatably supported in bearing 2 which is mounted in bearing housing 3 on post 1. Main pulley 5 is fixed to the outer end of main shaft 4 and is rotatably coupled to driving pulley 7 by means of main transmission 6.

Main shaft 4 has rotatably mounted thereon main bearing 9 which is fixed in main bearing housing 10 on main support 8. Supported on main support 8 are upper bearing 60 and lower bearing 59. Rotatably mounted on upper and lower bearings 60 and 59 are shafts 64 and 63, respectively. Pulleys 17 and 18 are fixed to shafts 64 and 63, rspectively. Pulleys 17 and 18 are connected, by means of transmissions 24 and 27, respectively, to upper and lower lateral pulleys 22 and 23, respectively. Pulleys 22 and 23 are fixed to upper and lower wheels 20 and 21 which are, in turn, pressure coupled to wheel 19. Wheel 19 is fixed to main shaft 4. Stabilizer 28 and light brake 29 are provided on main support 8. A tube 46 with a main brake 54 is inserted into main shaft 4.

Figure 2:
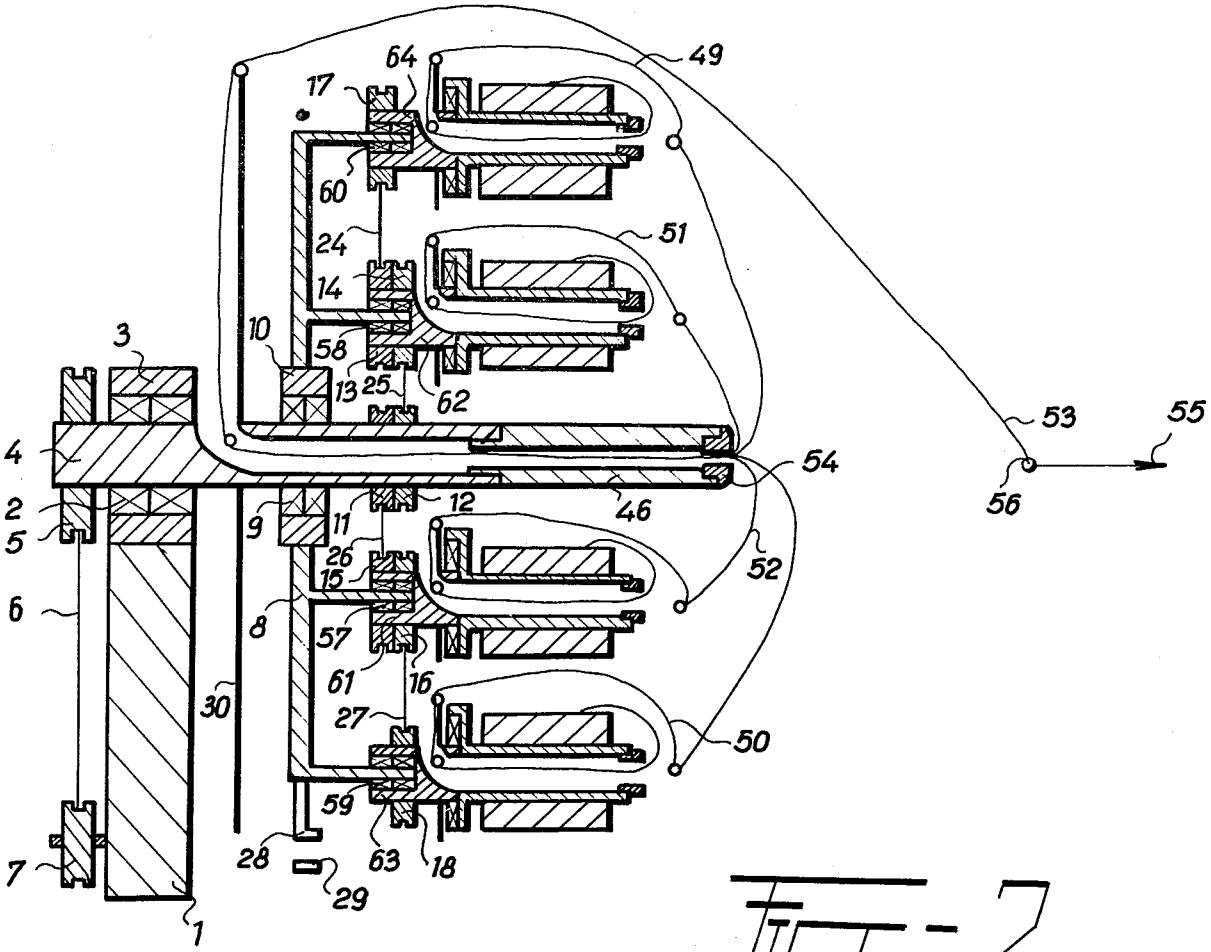
FIG. 2 is a sectional elevational view of a mutlitwist spindle with four countershafts according to another embodiment of the invention.
Figure 7:
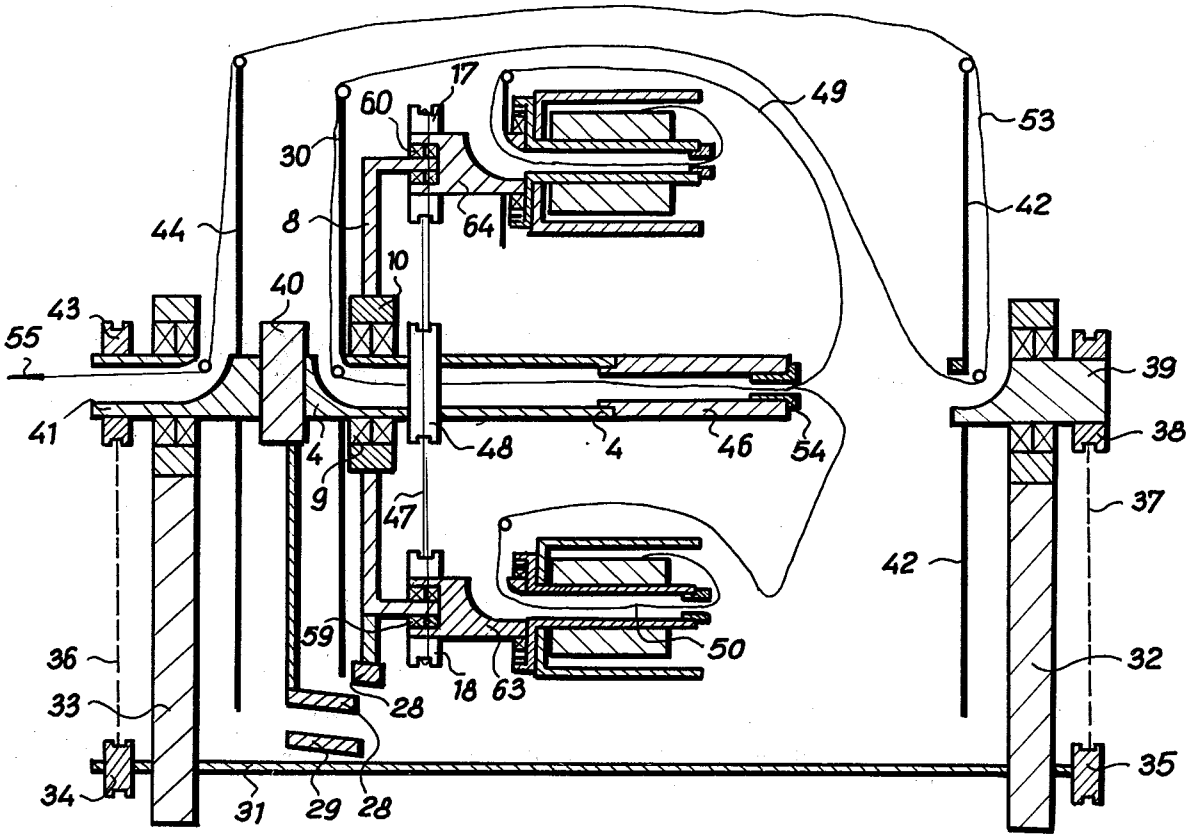

Turning now to FIG. 2, it will be seen that the basic relationship of the main shaft 4 to the supporting and driving means represented by the numerals 1 through 3 and 5 through 7 is the same as in the embodiment of FIG. 1. Similarly, main support 8 is mounted on main shaft 4 through main bearing 9 as in the embodiment of FIG. 1. Main support 8, in addition to supporting upper and lower bearing 60 and 59, and upper and lower shafts 63 and 64, supports a second upper bearing 58 and shaft 62 and a second lower bearing 57 and shaft 61. For ease in description, the upper and lower bearings 60 and 59 and the upper and lower shafts 64 and 63 will sometimes be referred to as the "outer" bearings and shafts while the second upper and lower bearings 58 and 57 and shafts 62 and 61 will sometimes be referred to as the "inner" bearings and shafts.

As in the embodiment of FIG. 1, the outer shafts 64 and 63 have fixed to them pulleys 17 and 18, respectively. Affixed to inner shaft 62 are pulleys 13 and 14, while affixed to inner shaft 61 are pulleys 15 and 16. Pulley 17 is connected to pulley 13 by means of transmission 24 and pulley 18 is connected to pulley 16 by means of transmission 27. Pulleys 14 and 15 are connected, respectively, to pulleys 12 and 11 which are mounted on main shaft 4.

Attention is now drawn to FIG. 3 which shows still another embodiment of the invention wherein a left shaft 41 is rotatably supported by left post 33 and is driven by means of pulley 43 which is connected through transmission 36 to pulley 34. Left shaft 41 has fixed to it left carrier 44 and is inserted into 40. Pulley 34 is fixed to the left end of drive shaft 31 which has fixed to the right end thereof, pulley 35.

Right post 32 rotatably carries right shaft 39 which is driven by pulley 38 connected by transmission 37 to pulley 35. Right shaft 39 has fixed thereto right carrier 42. Main shaft 4 is driven through differential gear mechanism 40 and carries pulley 48. Pulleys 17 and 18 are connected to pulley 48 through transmission 47.

Figure 4:
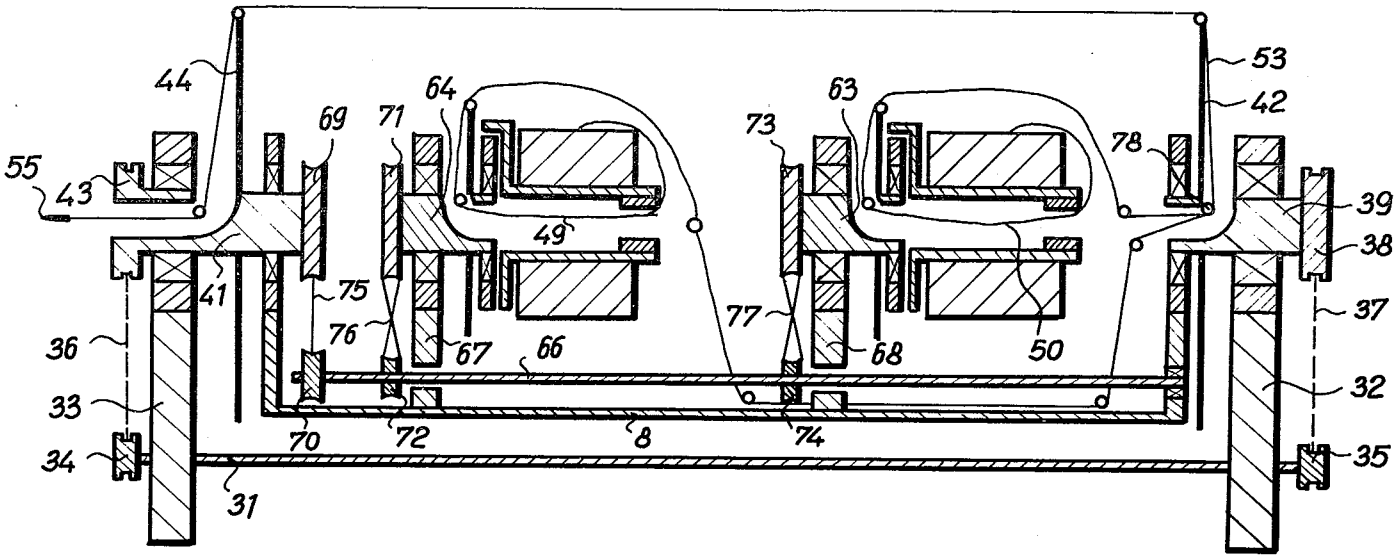
FIG. 4 is a sectional elevational view of a multitwist spindle with first and second main carriers according to a fourth embodiment of the invention.

In the embodiment of FIG. 4, left shaft 41 is rotatably supported on left post 33 and driven by means of pulley 43 which is connected, through transmission 36, to pulley 34. Similarly, right shaft 39 is rotatably mounted on right post 32 and is driven by means of pulley 38 which is connected, through transmission 37, to pulley 35. Pulleys 34 and 35 are mounted on either end of drive shaft 31. Left carrier 44 is fixed to left shaft 41 and right carrier 42 is fixed to right shaft 39. Left and right shafts 41 and 39 are carried by main support 8. In addition, left inner post 67 and right inner post 68 are carried on main support 8. Left inner shaft 64 is rotatably mounted on left inner post 67 and right inner shaft 63 is rotatably mounted on right inner post 68. Pulley 69, fixed to shaft 41, is connected, through transmission 75, to pulley 70 which is fixed to a second drive shaft, 66. Pulley 72 on drive shaft 66 is connected through transmission 76 to pulley 71 mounted on shaft 64. In a like manner, pulley 74 on drive shaft 66 is connected through transmission 77 to pulley 73 mounted on shaft 63. The other end of drive shaft 66 from pulley 70 is journalled for rotation in main support 8.

In operation, an external driving source (not shown) turns driving pulley 7 (FIGS. 1 and 2) or 34 (FIG. 3) which, in turn, drives transmission 6 and pulley 5 (FIGS. 1 and 2) or transmission 36 and pulley 43 (FIG. 3) to, thereby, turn main shaft 4 (FIGS. 1 and 2) or left shaft 41 and main shaft 4 (FIG. 3). Main carrier 30 turns with main shaft 4 and left carrier turns with left shaft 41 (FIG. 3). Also, middle wheel 19 (FIG. 1), pulleys 11 and 12 (FIG. 2), or pulley 48 (FIG. 3) are rotated as main shaft 4 turns. This rotation causes turning of pulleys 17 and 18 through pulleys 22 and 23 and wheels 20 and 21 in the embodiment of FIG. 1; turning of pulleys 13 and 15 as well as pulleys 14 and 16 which, in turn, drive pulley 17 and 18, in the embodiment of FIG. 2; or turning of pulleys 17 and 18 which are directly connected to pulley 48 through transmission 47, in the embodiment of FIG. 3. This rotation of pulleys 17 and 18, and pulleys 13-14 and 17-18 in the embodiment of FIG. 2, causes shafts 64 and 63, and 62 and 61 in the embodiment of FIG. 2 to rotate.

In the embodiment of FIG. 3, when the external source of power drives pulley 34, drive shaft 31 and pulley 35 are also driven. This, in turn, drives pulley 38 through transmission 37, and right shaft 39 to which right carrier 42 is affixed, causing right carrier 42 to turn.

The embodiment of FIG. 4 operates in much the same way as that of FIG. 3. An external source of power drives pulley 34 and drive shaft 31. The turning of pulley 34 drives pulley 43 through transmission 36. Pulley 43, in turn, drives shaft 41 which, through pulley 69, transmission 75, and pulley 70, drives drive shaft 66. When drive shaft 66 turns, it transmits the motion to shaft 64 through pulley 72, transmission 76, and pulley 71, and to shaft 63 in a similar manner.

With each revolution of the multitwist spindle of the invention, regardless of which embodiment is used, the fibers 49 and 50 (FIGS. 1, 3 and 4) or 49–52 (FIG. 2) pass over the main brake 54 (FIGS. 1, 2 and 3) or over the roller 78 (FIG. 4) to obtain two twists. Passage of the twisted fibers 53 over the main carrier 30 and eyelet 56 (FIGS. 1 and 2), the main carrier 30 and the right and left carriers 42 and 44 (FIG. 3), or over the right and left carriers alone (FIG. 4) to a takeup mechanism (not shown), produces two combined twists of the same or opposite direction.

Referring to FIG. 3, it will be seen that right shaft 39 and left shaft 41 have the same direction of rotation. The use of differential gear mechanism 40 makes it possible to rotate pulley 48 in the opposite direction.

What is claimed is:

1. A multitwist spindle for processing of endless fibers comprising a pair of spaced apart upright supports, a main support located between said upright supports, a drive shaft rotatably mounted at the lower end portion of each upright support and extending therethrough, a shaft rotatably mounted at the upper end portion of each upright support, each said shaft additionally being rotatably supported by said main support, two countershafts rotatably supported by said main support, a yarn carrier fixed to each countershaft, and means for operably connecting said shafts and countershafts for rotation.

2. A multitwist spindle for processing of endless fibers comprising:

a fixed post including main support bearing means, a main shaft rotatably mounted on said fixed post and rotatably supported in said main support bearing means;

a main yarn carrier means fixed to said main shaft;

main support means mounted on said main shaft by means of said main support bearing means;

two countershafts rotatably mounted on said main support means;

first rotating means operatively connected to said main shaft to rotate the same, said first rotating means comprising a differential gear mechanism, a left shaft supported for rotation in a left post and rotating in said differential gear mechanism, said differential gear mechanism in turn rotating said main shaft;

second rotating means operatively connecting said countershafts to said main shaft to simultaneously rotate said countershafts, said second rotating means comprising a pulley fixed to said main shaft, a pulley fixed to each countershaft, and belt means connecting said first mentioned pulley to both of said last mentioned pulleys;

a right shaft supported for rotation in a right post;

a drive shaft operatively connecting said left and right shafts for mutual rotation;

a left carrier fixed to said left shaft; and a right carrier fixed to said right shaft.

3. A multitwist spindle for processing of endless fibers comprising a pair of spaced apart upright supports, a main support located between said upright supports, a drive shaft rotatably mounted at the lower end portion of each upright support and extending therethrough, a shaft rotatably mounted at the upper end portion of each upright support, each said shaft additionally being rotatably supported by said main support, two countershafts rotatably supported by said main support, a yarn carrier fixed to each countershaft, a pulley on each shaft, a pulley at each end of said drive shaft, belt means for rotatably connecting said pulley on each shaft with one of said pulleys on said driveshaft, a second pulley on one of said shafts, a second drive shaft mounted for rotation on said main support, a pulley on each countershaft, three pulleys on said second drive shaft each disposed in proximity to one of the pulleys on said shaft and said countershafts, respectively, and belt means for rotatably connecting said pulleys in proximity to each other.

4. A multitwist spindle for processing of endless fibers comprising a fixed post including main support bearing means, a main shaft rotatably mounted on said fixed post and rotatably supported in said main support bearing means, a main yarn carrier means fixed to said main shaft, main support means mounted on said main shaft by means of said main support bearing means, two countershafts rotatably mounted on said main support means, means operatively connected to said main shaft to rotate the same, and means operatively connecting said countershafts to said main shaft to simultaneously rotate said countershafts, said means operatively connecting said countershafts to said main shaft comprising a wheel fixed to said main shaft, two wheels pressure coupled to said first mentioned wheel, a pulley fixed to each of said last mentioned wheels, a pulley fixed to each countershaft, and belt means connecting each of said first mentioned pulleys to one of said last mentioned pulleys.

5. A multitwist spindle for processing of endless fibers comprising a fixed post including main support bearing means, a main shaft rotatably mounted on said fixed post and rotatably supported in said main support bearing means, a main yarn carrier means fixed to said main shaft, main support means mounted on said main shaft by means of said main support bearing means, two outer countershafts and two inner countershafts rotatably mounted on said main support means, means operatively connecting said countershafts to said main shaft to simultaneously rotate said countershafts, said means operatively connecting said countershafts to said main shaft comprising a pair of pulleys fixed to said main shaft, a pair of pulleys fixed to each of said inner countershafts, a pulley fixed to each of said outer countershafts, belt means connecting one of said pulleys on said main shaft with one of said pulleys on one of said inner counter shafts, belt means connecting the other of said pulleys on said main shaft with one of said pulleys on the other of said inner countershafts, and belt means connecting the other pulley on each of said inner countershafts to the pulley on a respective one of said outer countershafts.

* * * * *